US005404594A

United States Patent [19]

Ring et al.

[11] Patent Number: 5,404,594

[45] Date of Patent: Apr. 11, 1995

[54] IN-LINE TOILET BOWL CLEANER APPARATUS

[76] Inventors: Russel F. Ring, 5950 W. Branch Rd.; Richard J. Morrison, 6650 Woodedge Rd., both of Minnetrista, Minn. 55364

[21] Appl. No.: 42,538

[22] Filed: Apr. 5, 1993

[51] Int. Cl.[6] ..... E03D 9/02

[52] U.S. Cl. ..... 4/224; 4/226.1; 422/261; 137/268

[58] Field of Search ..... 4/223, 224, 226.1, 227.1; 422/261, 263, 264; 137/268

[56] References Cited

U.S. PATENT DOCUMENTS

| | | | |
|---|---|---|---|
| 960,984 | 6/1910 | Melville | 4/226.1 |
| 1,691,359 | 11/1928 | Pulkinghorn | 4/226.1 |
| 1,930,500 | 10/1933 | Archibald | 422/263 |
| 2,044,821 | 6/1936 | Urban | 422/264 |
| 2,067,328 | 1/1937 | Lux | 4/226.1 |
| 2,582,175 | 1/1952 | Stitz et al. | 422/263 |
| 3,001,210 | 9/1961 | Diehl | 4/225.1 |
| 3,060,456 | 10/1962 | Jacobs | 4/226.1 |
| 3,123,253 | 3/1964 | Lambton | 4/226.1 X |
| 3,373,744 | 3/1968 | Kendall | 137/268 X |
| 4,262,372 | 4/1981 | Ryder | 4/222 |
| 4,778,786 | 10/1988 | Reever et al. | 514/54 |
| 4,778,789 | 10/1988 | Fex et al. | 514/210 |
| 4,873,727 | 10/1989 | Homan | 4/226.1 |
| 4,984,306 | 1/1991 | Sumerix | 4/224 |

*Primary Examiner*—Robert M. Fetsuga

*Attorney, Agent, or Firm*—Merchant, Gould, Smith, Edell, Welter & Schmidt

[57] ABSTRACT

A toilet in-line apparatus is in-line connected to a water supply tube. The apparatus includes a cartridge containing a chemical compound, an in-line conduit for conducting water from the water supply tube, a first mounting member for mounting a first end of the cartridge onto a first end of the in-line conduit, a valve for controlling the flow of water through the in-line conduit, a second mounting member for mounting the valve onto a second end of the in-line conduit. The valve is adjusted to control the percentage of the water and the chemical compound. The in-line conduit includes an axial bore, an inlet passageway, an outlet passageway, a passageway disposed between a first end of the in-line conduit and the axial bore. The chemical compound includes a cleaning agent, an air freshener agent, and a coloring agent.

10 Claims, 4 Drawing Sheets

FIG. 2
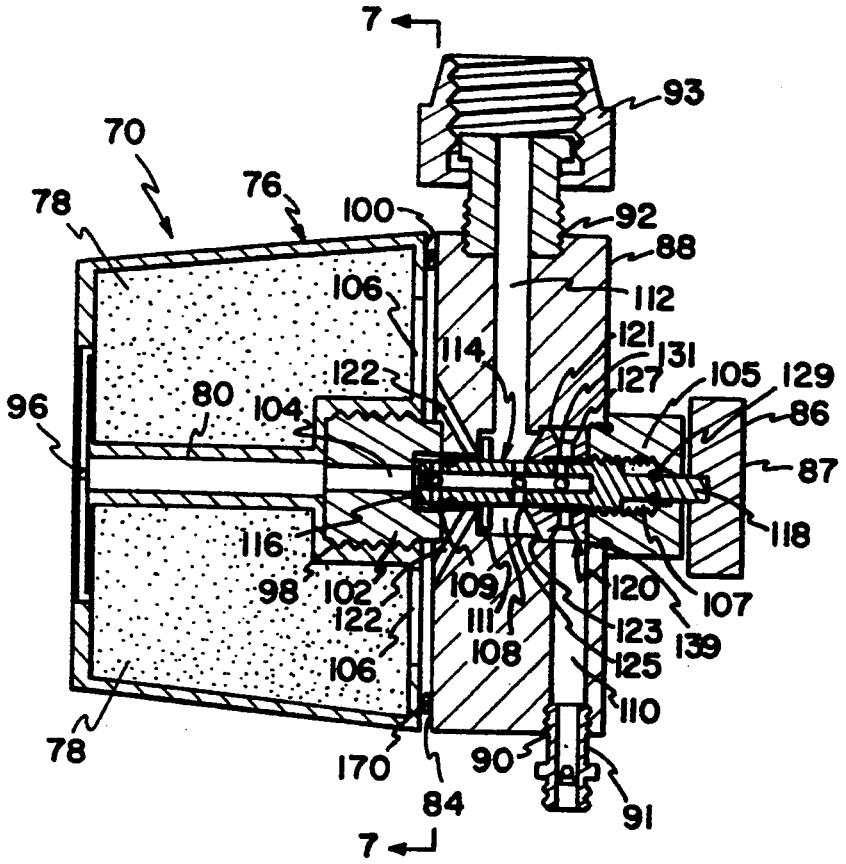
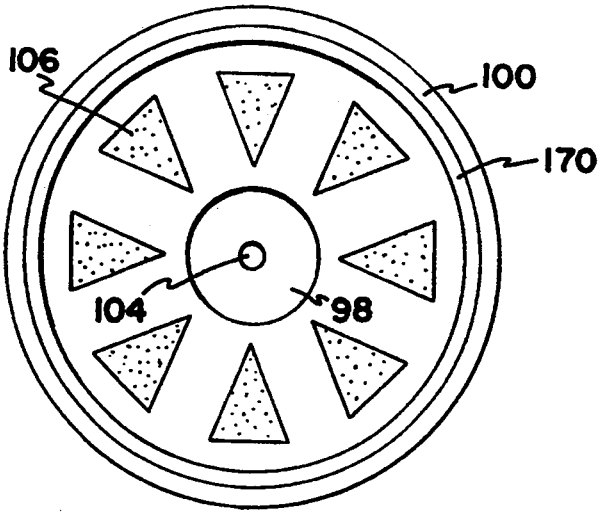
FIG. 7

IN-LINE TOILET BOWL CLEANER APPARATUS

FIELD OF THE INVENTION

The present invention relates to an in-line toilet bowl cleaner apparatus.

BACKGROUND OF THE INVENTION

Currently, there are many toilet bowl cleaners available in the market. These toilet bowl cleaners are typically placed in the toilet water reserve tank. Often, these cleaners are extremely corrosive to the toilet internal parts and the water reserve tank.

In addition, current toilet bowl cleaners tend to coagulate, and thus, clog the toilet parts in use. The coagulation of the cleaners also results in inconsistent performance in the cleaning process whereby the cleaners release either too much or too little cleaning agent into the toilet bowl. Another disadvantage of current toilet bowl cleaners is that the cleaners only last about three weeks. Because of the added cost and maintenance requirements, many consumers and businesses do not use existing toilet bowl cleaners.

Furthermore, most existing cleaners do not provide air freshening scent. Consumers have to purchase additional fragrance or air freshener for refreshing air in bathrooms.

Since there are over 200 million toilets in the U.S. and a conservative estimate indicates that more than two (2) million new toilets are installed every year. A high quality, long lasting toilet bowl or urinal system cleaner is needed. In addition, recent legislation makes the use of smaller water reserve tanks, such as the 1.6 gallon tank (as opposed to older 3 to 5.5 gallon models) mandatory in new construction and remodeling projects. The 1.6 gallon toilets are designed to conserve water with the use of a "tank within a tank". The new design means that the current toilet reserve tanks are no longer accessible to consumers so that the use of drop-in cleaning and coloring products will not be possible in many systems.

The present invention provides an improved toilet bowl cleaner apparatus which solves many of the above noted problems.

SUMMARY OF THE INVENTION

The present invention relates to an in-line toilet bowl cleaner apparatus.

In addition to being used with toilet bowls, the present invention might be used with other water fixture systems such as urinal systems or the like which require cleaning and/or air freshener/colorant.

One embodiment of the present invention relates to a toilet in-line apparatus including a cleaning compound, a coloring agent and an air freshener, which are adjustably released from the apparatus to the toilet system. The in-line line apparatus is mounted along the water line leading to the toilet so that when the toilet is flushed water flows through the in-line apparatus to the toilet from the water supply.

One advantage of the present invention is that it provides a simple design, high quality and long-lasting toilet bowl system cleaner apparatus which is easily maintained.

An advantage of one embodiment of the present invention is that it meets consumers requirements by incorporating three desired elements: a cleaning compound, a coloring agent and an air freshener.

Another advantage of one embodiment of the present invention is that the apparatus substantially eliminates coagulation of chemical compound and provides an even disbursement of the chemical compound into a toilet bowl so that waste of chemical compound is minimized.

Another advantage is that one embodiment of the present invention provides a replaceable toilet bowl cleaner cartridge which contains the cleaning compound. Thus by simple replacement of the cartridge, the cleaning compound can be replaced thereby renewing the cleaning action of the toilet bowl cleaner.

In yet another embodiment of the invention, the cartridge is refillable with cleaning agent.

In one embodiment, the toilet bowl cleaner apparatus can be turned off while replacing or refilling the chemical compound to prevent the leakage of water and yet allow the uninterrupted flow of water to the toilet bowl so that the toilet can be used even while the cartridge is removed or being replaced.

Yet another advantage of the present invention is that the chemical compound contains substantially non corrosive elements, therefore eliminating damage to the internal toilet parts.

A substantial advantage of the present invention is that the toilet bowl cleaner apparatus is installed in-line of the toilet bowl. This unique installation allows a chemical compound containing cleaning agent to mix with the water before the water enters the toilet.

Another advantage of one embodiment of the present invention is that the release of the chemical compound is adjustable so that the consumers can increase or decrease the volume of the water/chemical compound mixture as desired.

Another advantage of one embodiment of the present invention is that the installation is easy and requires the use of a hand tool such as a crescent wrench and does not require a plumber.

One embodiment of the present invention relates to a cleaner apparatus used with a water fixture system, comprising:

- a cartridge containing a cleaning agent;
- in-line conduit means for conducting water from a water supply tube to the water fixture system;
- first mounting means for mounting the first end of the cartridge onto a first end of the in-line conduit means;
- valve means for controlling flow of water through the in-line conduit means;
- second mounting means for mounting a first end of the valve means onto a second end of the in-line conduit means; and
- means for adjusting the valve means so as to control the percentage of the water and water/toilet bowl cleaner mixture.

Yet another embodiment of the present invention relates to a valve assembly for adjusting a flow direction of a fluid in a multi-port connector, comprising:

- a sleeve member having means for conducting the fluid from an input port of the multi-port connector;
- a valve member, having means for conducting the fluid to a first output port of the multi-port connector and means for conducting the fluid to a second output port of the multi-port connector, slidably received in the sleeve member;

means for conducting the fluid between the valve member and the sleeve member;

means for distributing the fluid between the first output port and the second output port; and means for adjusting the distributing means having at least three positions, wherein the distributing means conducts the entire fluid to the first output port when the adjusting means is in a first position, the distributing means conducts the fluid to both the first and second output ports when the adjusting means is in a second position, and the distributing means conducts the entire fluid to the second output port when the adjusting means is in a third position.

These and various other advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings in which like reference numerals and letters generally indicate corresponding parts throughout the several views:

FIG. 2 is a cross-sectional view of an embodiment of an in-line toilet bowl cleaner apparatus generally in accordance with the principles of the present invention;

FIG. 7 is an end view of the cartridge as generally seen along line 7—7 of FIG. 2.

DETAILED DESCRIPTION OF THE PREFERRED EMBODIMENT

Figure 1:
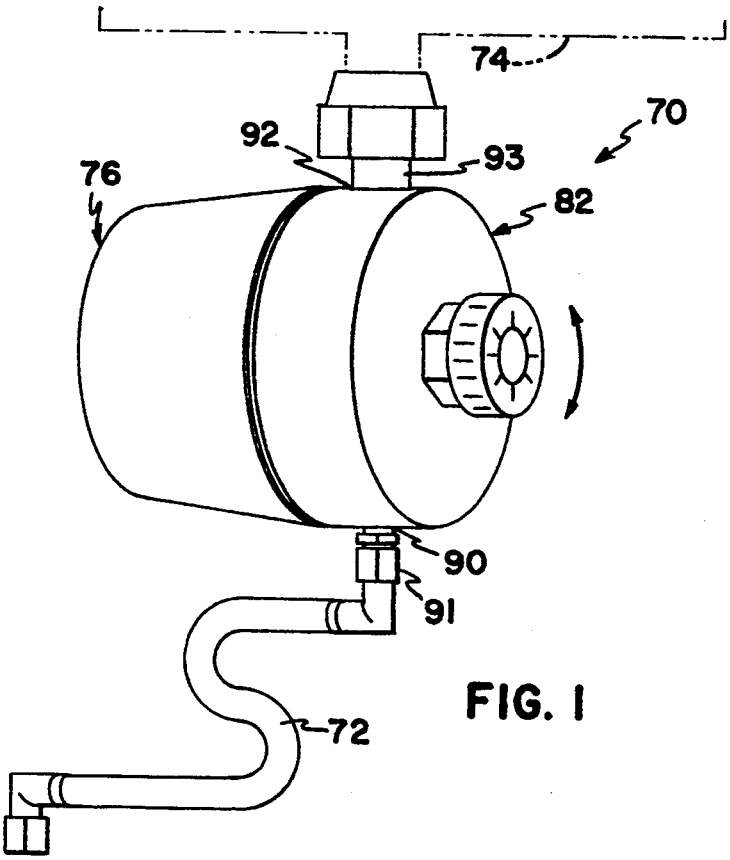
FIG. 1 is a perspective view of an embodiment of an in-line toilet bowl cleaner apparatus generally in accordance with the principles of the present invention shown in use with a toilet bowl system.

As shown in FIG. 1, an embodiment of a toilet in-line apparatus 70 in accordance with the principles of the present invention is connected to a water supply tube 72 at an inlet end of the in-line apparatus 70 and to a toilet bowl 74 at an outlet end of the in-line apparatus 70. Alternatively, the toilet in-line apparatus 70 can be connected to other water fixture systems such as a urinal system (not shown). The toilet in-line apparatus 70 can be used with most standard toilets and can be disposed in any orientation; e.g., horizontally or vertically.

The toilet in-line apparatus 70 includes a removable cartridge 76 (shown in FIGS. 4–6) which contains a chemical compound 78 therein. In the preferred embodiment, the chemical compound 78, combining a cleaning chemical, a coloring agent and an air freshener, is placed in the cartridge 76 along a fluid passageway 80 (shown in FIG. 2). The air freshener is available in several scents, such as pine, wild flower, powder, etc. Additionally, various colorants and cleaning agents are available. The chemical compound 78 in the cartridge 76 might be refillable or replaceable so that the cartridge 76 can be further used. The chemical compound 78 will preferably last several days; e.g., about 90 days with normal use.

The unit size of the toilet in-line apparatus 70 is relatively small compared to the whole toilet bowl system. For example, the cartridge 76 might have a length of roughly 2 inches with a diameter of roughly $3\frac{1}{4}$ inches at its largest end. Total length of the in-line apparatus including the cartridge 76 might be roughly 4 inches.

One embodiment of a cleaning compound might be made according to the following formula:

| Trade Name | Chemical Name | Vendor | Weight % |
|---|---|---|---|
| T-DET N 100 | NONOXYNOL-100 | HARCROS | 40 |
| SPAN 60 | SORBITAN STEARATE | ICI | 16 |
| ALFOL 18 | STEARYL ALCOHOL | GLENN INC. | 16 |
| FRAGRANCE | CC 40991 | UNGERER | 15 |
| XYLENE VSG | ACID BLUE 9 SODIUM SALT | GLENN INC. | 10 |
| CITRIC ACID | | GLENN INC. | 03 |

In one embodiment the chemical compound is made by melting the T-DET. This might be accomplished by placing it in a hot room or on a band heater. SPAN 60 and ALFOL 18 are added to a mixing tank and are simultaneously heated and mixed. When the SPAN 60 and ALFOL 18 begins to melt the melted T-DET is added. When all the ingredients are melted, the heat is turned off and while continuing to mix the ingredients, XYLENE VSG is added. Mixing is continued while the ingredients are cooled to 60 degrees Centigrade. The fragrance is then added. The temperature is maintained and the compound is filled into the cartridge.

The cartridge 76 is threadedly mounted onto an in-line conduit housing 82 at a first end 84 of the housing 82. The in-line conduit housing 82 defines a path for the flow of water through the housing 82 from the inlet port 90 to an outlet port 92. An adjusting knob 86 is mounted onto the in-line conduit housing 82 at a second end 88 of the housing 82. The water supply tube 72 brings water from a water supply source (not shown) to the inlet port 90 of the in-line conduit housing 82. Various attachment apparatus and/or mounting means 91, such as bolts, nuts and washers, might be used to connect the water supply tube 72 to the inlet port 90. The in-line conduit housing 82 conveys the water to the toilet bowl 74 through the outlet port 92 of the in-line conduit housing 82. Well-known attachment apparatus and/or mounting means 93, such as bolts, nuts and washers, might be used to connect the outlet port 92 to the water reserve tank of the toilet bowl. It will be appreciated that the in-line conduit housing 82 need not be attached directly to the water reserve tank but might be connected in any suitable manner to the toilet bowl system. For example, the in-line conduit housing 82 might even be located in another room.

Figure 4:
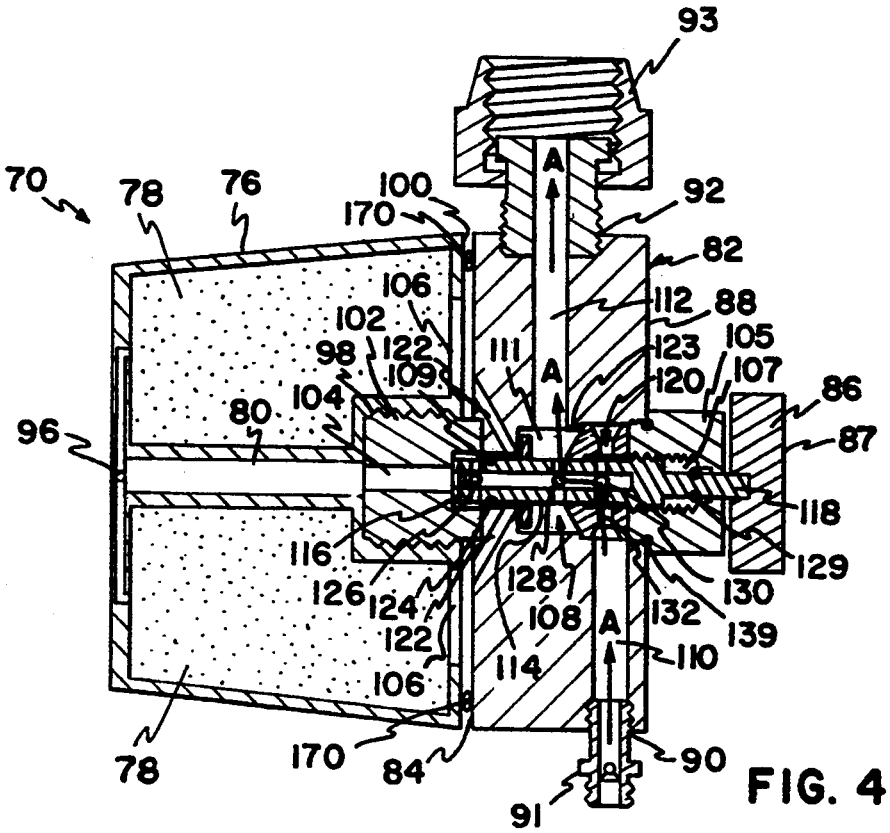
FIG. 4 is a cross-sectional view of a closed position of the toilet in-line apparatus.
Figure 5:
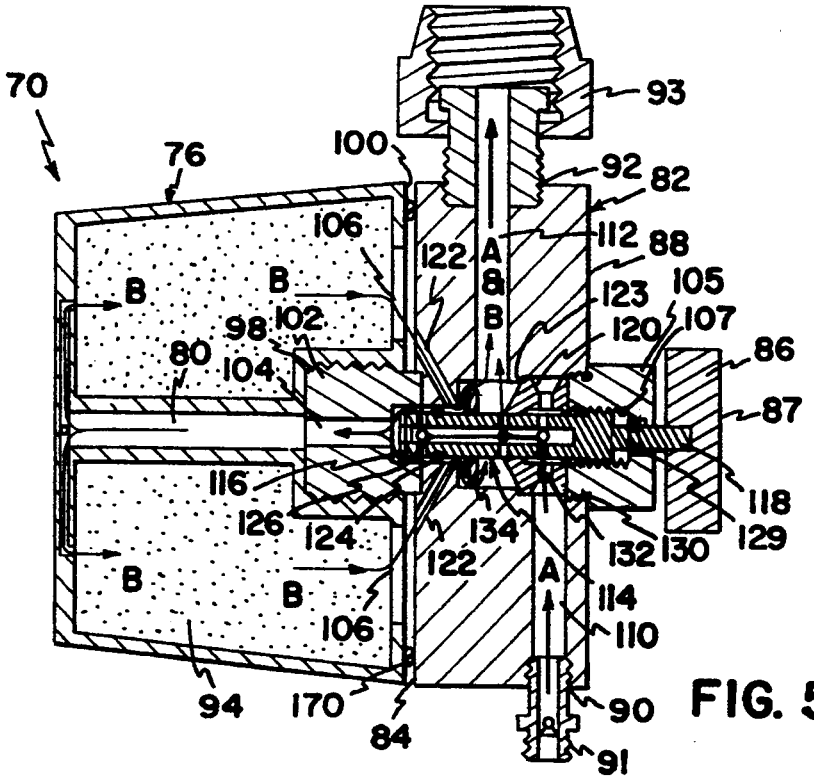
FIG. 5 is a cross-sectional view of a partially open position of the toilet in-line apparatus.
Figure 6:
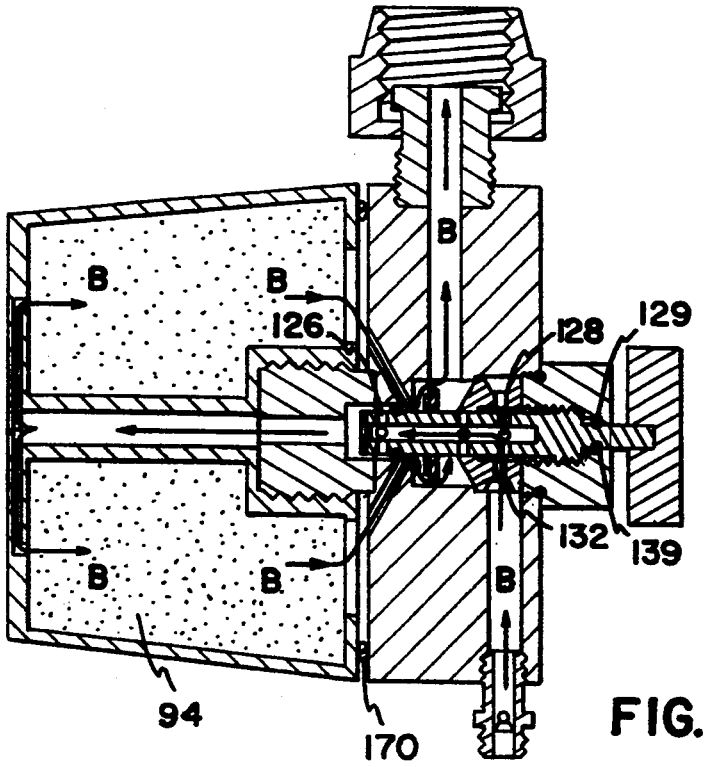
FIG. 6 is a cross-sectional view of an entirely open position of the toilet in-line apparatus.

Water in the water supply tube 72 is delivered to the toilet bowl 74 through the toilet in-line apparatus 70 when the toilet is flushed. In FIGS. 4–6, the primary water flow is vertical to the installation of the toilet in-line apparatus 70. Alternatively, the installation of the toilet in-line apparatus 70 can be parallel to the primary water flow or oblique to the primary water flow.

FIG. 2 shows a cross-sectional view of the toilet in-line apparatus 70 which is shown in FIG. 1. The fluid passageway 80, through which water flows into the cartridge, is disposed along a longitudinal axis of the cartridge 76. The passageway 80 extends to a bottom end of the cartridge where a fluid passageway 96 extends radially of the cartridge 76. The water flows from the passageway 80 to the passageway 96 and then flows back through the cartridge 76 external of the passageway 80. The chemical compound 78 is placed in the cartridge 76 so that the water absorbs the chemical compound 78 as the water flows back through the cartridge 76 toward the housing 82.

A threaded bore 98, disposed at a first end 100 of the cartridge 76, receives a correspondingly threaded hollow elongated member 102 which is suitably mounted on the first end of 84 of the in-line conduit housing 82. The diameter of the passageway 80 is smaller than that of the bore 98 but larger than that of a bore 104 in the hollow elongated member 102. The bore 104 conducts the water from the in-line conduit housing 82 to the cartridge 76.

A plurality of apertures 106 are disposed in the end of the cartridge 76 (see FIG. 7 which shows one embodiment of a cartridge having a plurality of openings 106). Since the water from the in-line conduit housing 82 is under pressure and the apertures 106 are the only other fluid passageways connecting the interior of the cartridge 76 to the in-line conduit housing 82, the water/-chemical compound mixture 94 flows back from the cartridge 76 to the in-line conduit housing 82 only through the apertures 106. An O-ring type of seal 170 is disposed on the end of the cartridge 76 between the end 84 of the in-line conduit housing 82 and the cartridge so as to form a fluid tight seal between the housing 82 and the cartridge 76 once the cartridge is threaded onto the elongated member 102.

Figure 3:
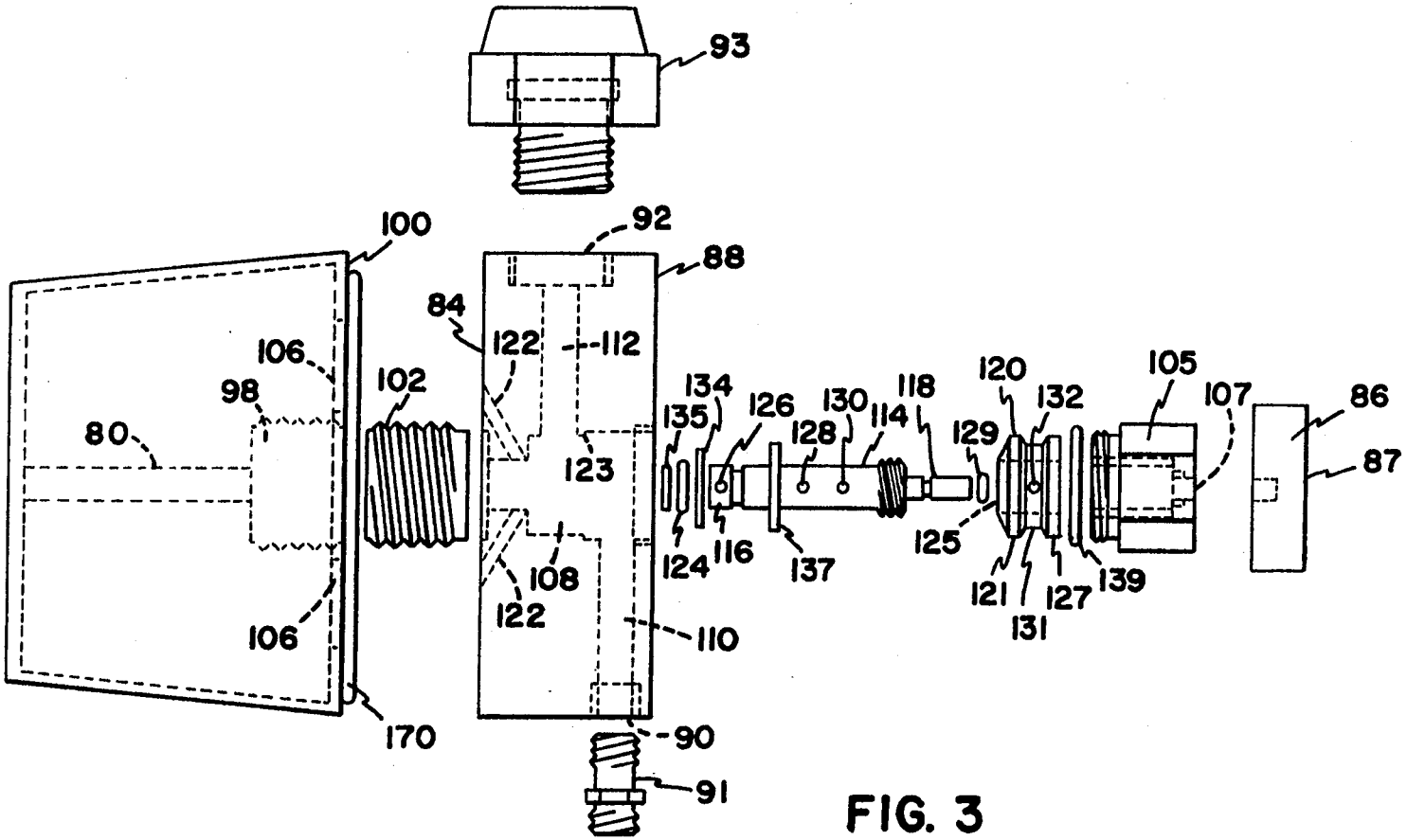
FIG. 3 is an exploded view of the toilet in-line apparatus shown in FIG. 2.

In FIGS. 2–3, there is shown a central bore 108 disposed in the in-line conduit housing 82. The central bore 108 has a smaller diameter section 109 close to the first end 84 and a larger diameter section 111 close to the second end 88. The diameter of the smaller diameter section 109 is larger than that of the bore 104 and is in fluid communication with the bore 104. A hollow screw 105 is partially threadedly received in the larger diameter section 111 at the second end 88.

A inlet passageway 110, connecting the central bore 108 to the inlet port 90, conducts water from the water supply tube 72 to the in-line conduit housing 82. An outlet passageway 112, connecting the central bore 108 and the outlet port 92, conducts water and/or water/-chemical compound mixture 94 from the in-line conduit housing 82 to the toilet bowl 74.

The central bore 108 of the in-line conduit housing 82 receives a hollow valve member 114. One end 116 of the valve member corresponds to the bore 104 of the hollow elongated member 102, whereas the other end 118 of the hollow valve member 114 passes through a bore 107 of the hollow screw 105 and fixedly connects to the adjusting knob 86. The hollow valve member 114 is threadedly mounted in the bore 107 of the hollow screw 105 for reciprocal movement thereof upon movement of the knob 86. Since the hollow valve member 114 can be moved relative to the screw 105, the relative position of the hollow valve member 114 in the central bore 108 is adjusted by turning the knob 86.

The adjusting knob 86 is suitably marked with a scale on a surface 87 of the knob 86 showing different positions of the hollow valve member 114 in the central bore 108. In particular there is a marking indicating when the in-line apparatus is turned off such that all of the water is flowing through the in-line apparatus without mixing with any of the chemical in the cartridge. Various positions might then be marked or scaled with numbers indicating relative mixing of the water supply with chemical in the cartridge. Alternatively, the knob 86 can be marked in a different set of scales. For example, the relative percentage of water flow through the chemical in the cartridge might be indicated.

A sleeve member 120 is fixedly mounted into the large diameter section 111 of the central bore 108 adjacent to the hollow screw 105 so as to be stationary. A front portion 121 of the sleeve member 120 has a tapered outer surface. The valve member 114 is slidably mounted relative to the sleeve member 120. Thus, the relative position between the hollow valve member 114 and the sleeve member 120 is adjusted by the knob 86. The outer diameter of the hollow valve member 114 and the inner diameter of the front portion 121 of the sleeve member 120 abut each other so that the water under pressure is blocked by the front portion 121. A middle portion 131, integral with the front portion 121 and the back portion 127, has a spool-shaped outer surface wherein the outer diameter is smaller than that of the front and back portions 121, 127. The inner diameter of the middle and back portions 131, 127 is larger than the outer diameter of the hollow valve member 114. Thus, a circular gap is disposed between the hollow valve member 114 and the middle and back portions 131, 127 so that water is free to flow therebetween.

Two passageways 122, circular in cross section, extend from the space defined between the housing 82 and the cartridge 76 to the central bore 108 of the in-line housing 82. The passageways 122 convey the water/-chemical mixture exiting the apertures 170 of the cartridge 76 to the central bore 108 of the in-line housing 82. An o-ring 124 slides over the hollow valve member 114 and is positioned in the smaller diameter section 109 of the central bore 108 between the first end 84 and the entrance of the conical passageway 122 to the central bore 108. The o-ring 124 is designed to fill in the space between the inside wall of the smaller diameter section 109 and the outside surface of the hollow valve member 114 so that the water/chemical mixture 94 is not allowed to flow back to the cartridge 76 from the first end 84 of the in-line conduit housing 82.

An o-ring 129 and an o-ring 139 are disposed on the end 118 and the hollow screw 105, respectively.

As shown in FIG. 3, the hollow valve member 114 includes three sets of orifices 126, 128 and 130 (only one orifice in each set is shown for purposes of illustration). Another set of orifices 132 is disposed on the middle portion 131 of the sleeve member 120 (only one orifice in the set is shown for purposes of illustration). The orifices 132 are disposed closer to the orifices 130 than 128. The middle portion 131 is aligned to the inlet passageway 110 so that water from the water supply tube 72 flows into the middle portion 131 of the sleeve member 120 through the orifices 132. The water then flows into the hollow valve member 114 through the orifices 130. Since the orifices 126 are at a downstream position compared to the orifices 128 and the end 116 is sealed by a seal member 135, most of the water under pressure flows to the outlet passageway 112 through the orifices 128 as opposed to flowing to the orifices 126 at the end 116 of the hollow valve member 114. When the orifices 128 are partially closed or entirely closed toward the outlet passageway 112, part of or substantially all of the water flows to the end 116 of the hollow valve member 114 and then flows to the cartridge 76 through the orifices 126 depending on how much the orifices 128 are closed.

In addition, a circular member 137, which projects from the outer surface of the hollow valve member 114, and a washer 134 are positioned between the orifices 126 and 128 so as to prevent the water from flowing to the orifices 126 along the outer surface of the valve member 114. The degree to which the orifices 128 are obstructed determines the path of the water flow and whether any water is mixed with chemical in the cartridge 76.

FIGS. 4–6 show operations of the toilet in-line apparatus 70. The adjusting knob 86 adjusts the relative position between the hollow valve member 114 and the sleeve member 120, i.e. the adjusting knob 86 adjusts the obstruction of the orifices 128 to the outlet passageway 112. In FIG. 4, the knob 86 is in a closed or off position. The orifices 128 are entirely open so that all the water flows to the outlet passageway 112 and no water flows to the cartridge 76 (see arrow A). In FIG. 5, the knob 86 is in a partially open position. The orifices 128 are moved toward the sleeve member 120 and are partially obstructed by the front portion 121 of the sleeve member 120. Thus, part of the water directly flows to the outlet passageway 112 (see arrow A) and the rest of the water flows to the cartridge 76 through the hollow valve member 114, the orifices 126; then through the bore 104 and into the fluid passage 80 so as to produce the water/chemical compound mixture 94; then through the rest of the cartridge 76, the circular aperture 106, the conical passageway 122 and back to the central bore 108 of the in-line conduit housing 82 (see arrow B). The water which is directly from the orifices 128 then combines with the water/chemical compound mixture 94 and flows to the outlet passageway 112 (see arrows A and B). In FIG. 6, the knob 86 is in an entirely open position. The orifices 128 are entirely covered by the front portion 121 of the sleeve member 120. Accordingly, all the water flows through the orifices 126 so that the maximum water/chemical compound mixture 94 is produced at this time and is further brought to the outlet passageway 112. As can be seen from above, the volume of the water/chemical compound mixture 94 is readily controlled by a user adjusting the knob 86.

Parts of the toilet in-line apparatus 70 can be made of various materials, such as metal, plastic or polymer, etc.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A cleaner apparatus adapted to be connected to a water supply tube, comprising:

a cartridge containing a chemical compound including a cleaning agent;

in-line conduit means for conducting water from the water supply tube;

first mounting means for mounting a first end of the cartridge onto a first end of the in-line conduit means;

valve means for controlling the flow of water through the in-line conduit means;

second mounting means for mounting the valve means onto a second end of the in-line conduit means; and means for adjusting the valve means so as to control the percentage of the water and the chemical compound.

wherein the in-line conduit means comprises:

an axial bore, wherein a hollow sleeve member of the valve means is fixedly received;

an inlet passageway conducting water from the water supply tube into the hollow sleeve member and a hollow valve member of the valve means through a first plurality of orifices of the hollow sleeve member and a second plurality of orifices of the hollow valve member, the hollow sleeve member being disposed along the hollow valve member;

an outlet passageway extending from the hollow valve member through a third plurality of orifices of the hollow valve member;

the hollow valve member further including a fourth plurality of orifices; and a passageway, disposed between the first end of the in-line conduit means and the axial bore, connecting an aperture of the cartridge to the axial bore of the in-line conduit means.

2. A cleaner apparatus in accordance with claim 1, wherein the adjusting means adjusts the relative position between the hollow sleeve member and the third plurality of the orifices of the hollow valve member so as to adjust a volume of water directly flowing to the outlet passageway, wherein when the third plurality of orifices are entirely open, water is conducted directly from the water supply tube to the outlet passageway, when the third plurality of orifices are partially closed, some water is conducted from the water supply tube to the outlet passageway through the cartridge, and when the third plurality of orifices are entirely closed to the outlet passageway, all the water is conducted from the water supply tube through the cartridge to the outlet passageway.

3. A cleaner apparatus in accordance with claim 2, wherein the hollow sleeve member includes a front portion which covers the third plurality of orifices when the third plurality of orifices are entirely close to the outlet passageway, a middle portion on which the first plurality of orifices disposed, and a back portion, the middle and back portions being in fluid communication with the second plurality of orifices so as to allow the water from the water supply tube to flow into the hollow valve member.

4. A cleaner apparatus in accordance with claim 3, wherein an o-ring, disposed between the fourth plurality of orifices and the passageway, forms a fluid tight seal between an outer surface of the hollow valve member and an inside wall of the axial bore so as to prevent water from flowing back into the cartridge.

5. A cleaner apparatus in accordance with claim 1, wherein the cartridge includes an air freshener agent.

6. A cleaner apparatus in accordance with claim 1, wherein the chemical compound comprises a coloring agent.

7. A cleaner apparatus in accordance with claim 1, wherein the chemical compound is a solid concentrate.

8. A cleaner apparatus in accordance with claim 1, wherein the chemical compound in the cartridge is replaceable.

9. A cleaner apparatus in accordance with claim 1, wherein the chemical compound in the cartridge is refillable.

10. A cleaner apparatus in accordance with claim 1, wherein the cartridge is interchangeable.

* * * * *